US007028646B1

(12) United States Patent
Wagner

(10) Patent No.: US 7,028,646 B1
(45) Date of Patent: Apr. 18, 2006

(54) COOLING SYSTEM FOR SKID STEER LOADER INCLUDING FAN ASSEMBLY MOUNTED TO ENGINE

(75) Inventor: Edward L. Wagner, Wichita, KS (US)

(73) Assignee: CNH America LLP, New Holland, PA (US)

( * ) Notice: Subject to any disclaimer, the term of this patent is extended or adjusted under 35 U.S.C. 154(b) by 0 days.

(21) Appl. No.: 11/018,467

(22) Filed: Dec. 21, 2004

(51) Int. Cl.
*F01P 7/02* (2006.01)

(52) U.S. Cl. ..... 123/41.12; 180/229; 180/68.1

(58) Field of Classification Search ..... 123/41.12, 123/41.49, 41.04; 180/6.48, 229, 68.1, 68.2
See application file for complete search history.

(56) References Cited

U.S. PATENT DOCUMENTS

| | | | |
|---|---|---|---|
| 1,424,391 | A | 8/1922 | Armstrong |
| 2,242,495 | A | 5/1941 | Wolf |
| 2,327,932 | A | 8/1943 | Scarratt et al. |
| 2,449,110 | A | 9/1948 | Eells |
| 4,117,902 | A | 10/1978 | Henline et al. |
| 4,589,379 | A | 5/1986 | Fujikawa et al. |
| 4,590,891 | A | 5/1986 | Fujikawa et al. |
| 4,696,361 | A | 9/1987 | Clark et al. |
| 4,815,550 | A | 3/1989 | Mather et al. |
| 4,955,455 | A | 9/1990 | Albright et al. |
| 4,962,825 | A | 10/1990 | Albright et al. |
| 6,202,777 | B1 | 3/2001 | Surridge |
| 6,216,778 | B1 | 4/2001 | Corwin et al. |
| 6,257,359 | B1 | 7/2001 | Granlund et al. |

OTHER PUBLICATIONS

MUSTANG-brand manual excerpt showing exploded view of engine, date pre-dates filing of subject patent application.

*Primary Examiner*—Tony M. Argenbright
*Assistant Examiner*—Katrina B. Harris
(74) *Attorney, Agent, or Firm*—Stephen A. Bucchianeri; John William Stader; Michael C. Harms

(57) ABSTRACT

The cooling system of a skid-steer loader provides for heat exchangers, e.g. liquid, oil coolers, mounted in the upper portion of an engine compartment and in direct communication with a forced air flow. Circulating air is drawn into the engine compartment from the rear, is carried over the engine and is blown out through the heat exchangers to cool the liquid within the heat exchangers. The housing of a centrifugal fan is rigidly coupled to the engine block and the fan is also directly coupled to the engine flywheel. This allows for closer tolerances between the fan and its housing which results in higher efficiency because this dual coupling to the engine inhibits differential vibration between the fan and the housing. Interconnection between the heat exchangers and fan housing is via a flexible bellows and an air diffuser.

9 Claims, 3 Drawing Sheets

COOLING SYSTEM FOR SKID STEER LOADER INCLUDING FAN ASSEMBLY MOUNTED TO ENGINE

CROSS-REFERENCE TO RELATED APPLICATIONS

None.

BACKGROUND OF THE INVENTION

The present invention relates generally to the field of work vehicles such as construction and agricultural vehicles, and more particularly to vehicles commonly referred to as skid-steer loaders.

A skid-steer vehicle is a compact, highly maneuverable vehicle which employs driving mechanisms on opposite sides of the vehicle for independently driving each set of wheels mounted thereon. In a skid-steer vehicle the engine is mounted in the rear. The traditional cooling system of prior art skid-steer vehicles aligns or stacks the cooling system in serial relationship with the engine. That is, the fan, the engine coolant liquid cooler (i.e. radiator) and the oil cooler are axially aligned behind the engine. This so-called "engine cooling stack" provides a relatively bulky cooling system.

While the structure shown in U.S. Pat. No. 4,117,902, issued on Oct. 3, 1978 to Henline et al., has helped to make the engine compartment and associated cooling system more compact, the connection of the fan shroud, housing, or scroll to an engine mount with the fan connected to the engine crank, has required greater clearances between fan blades and shroud to inhibit the fan striking the shroud due to differential vibration between the shroud and fan during engine and/or vehicle operation. This results in a loss of efficiency of the fan and requires a larger fan to maintain proper cooling of the engine coolant liquid cooler and oil cooler.

Accordingly, it is not only desirable to shorten the length of this stack to provide a relatively compact and efficient cooling system for a skid-steer loader, but to provide a fan structure which allows for an increase in cooing efficiency by inhibiting differential vibration between the fan blades and shroud. Moreover, it is desirable to provide a cooling system design which allows for greater visibility to the rear of the vehicle by the vehicle operator. In this manner, a more compact cooling system will provide for a smaller engine compartment, permitting more efficient cooling of the engine.

SUMMARY OF THE INVENTION

In view of the above one aspect of the present invention is to provide an improved cooling system for a work vehicle such as a skid steer loader to increase cooling efficiency.

Another aspect of the present invention is provided by mounting the shroud of a centrifugal fan or blower to the same platform as the enclosed cooling fan to inhibit differential vibration between the fan and shroud.

Yet another aspect of the present invention is to provide a fan structure which accommodates engine or other vibration between the output side of the fan and the engine coolant liquid and/or oil coolers.

In a work vehicle constructed in accordance with the present invention, for example a skid-steer vehicle, an internal combustion engine is mounted in the rear of the vehicle and overlies the rear axle. A fan assembly including a fan within a shroud, is rigidly mounted to the same platform, i.e. the engine, to create negative pressure in the engine compartment. That is, the fan draws ambient air into the engine compartment through ventilating openings, e.g. louvers provided in the rear portion of the engine compartment, carries the ambient air over the engine and pushes it out through a cooler for the engine cooling liquid mounted at an upper front portion of the compartment. An oil cooler is mounted adjacent to and preferably beneath the radiator. Inasmuch as the cooler (radiator) and oil cooler are connected to the vehicle frame, a flexible coupling, e.g. bellows structure is provided intermediate the fan assembly air outlet and an air diffuser connected to the coolers.

The cooling system of the present invention is more efficient than the conventional engine-fan-radiator-oil cooler stack of the prior art while the compact structure of the present invention improves operator visibility to the rear of the skid-steer vehicle.

Other aspects and a more complete understanding of the present invention may be had by referring to the following specification and claims taken in conjunction with the accompanying drawings in which:

DETAILED DESCRIPTION OF THE PREFERRED EMBODIMENTS

Figure 1:
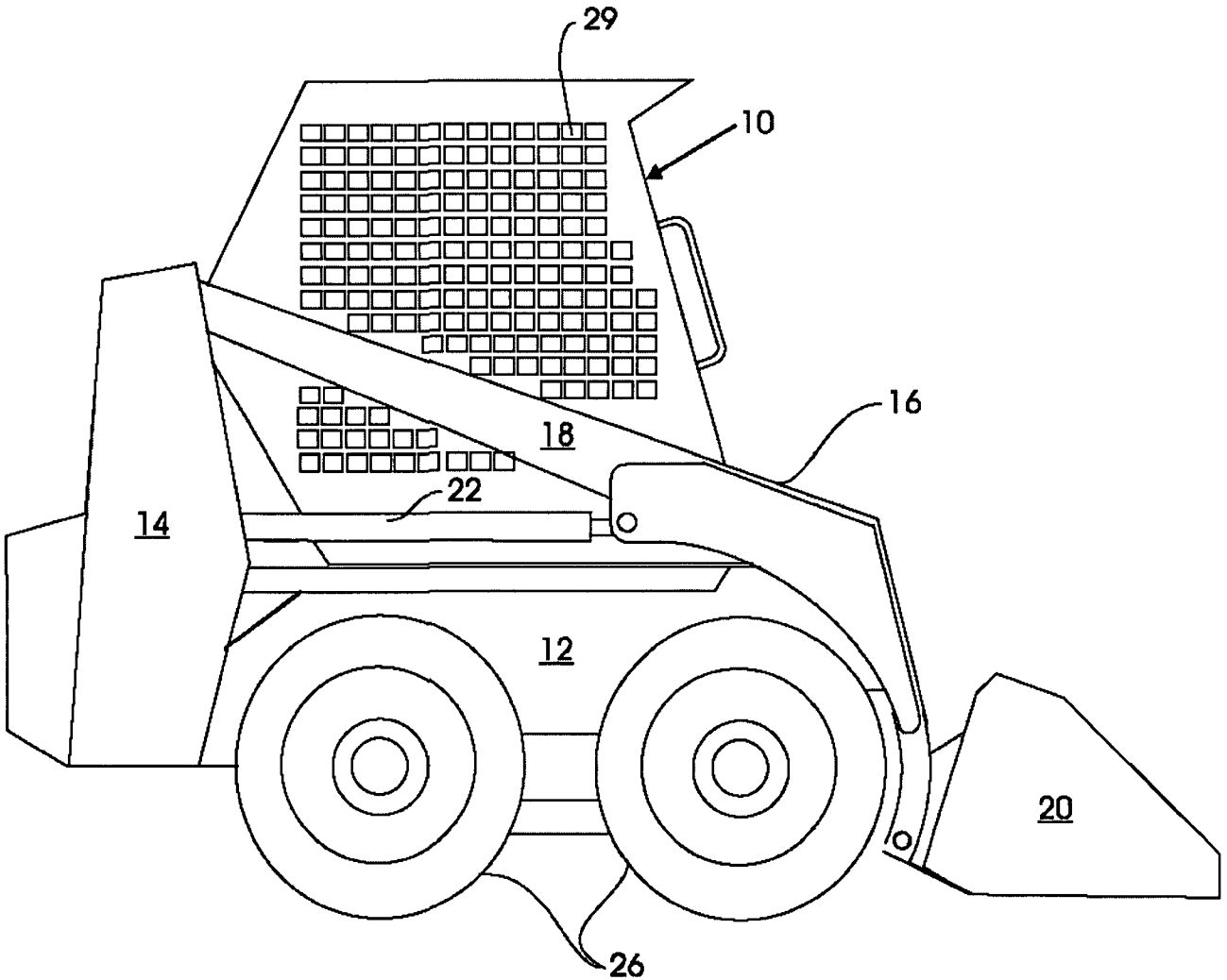
FIG. 1 is a schematic side elevational view of a work vehicle, in the present instance a skid-steer vehicle, employing a centrifugal engine cooling system constructed in accordance with the present invention.

Referring now to FIG. 1, a loader type work vehicle, in the illustrated instance a skid-steer vehicle 10 including a body portion 12 has mounted on opposite sides of the body portion rear uprights 14. The uprights 14 carry at an upper end portion thereof a loader arm assembly 16 pivotally mounted thereon and comprising oppositely disposed loader arms 18. The loader arms 18 extend outwardly at the front end of the vehicle to pivotally engage a work lifting device, in the illustrated instance a bucket 20. While two loader arms are shown, a single loader arm may be used. Lift cylinders 22 control the loader arms 18 and a tilt cylinder (not shown) controls the bucket 20. Two sets of wheels 26 are provided on opposite sides of the vehicle 10. Each set of wheels 26 is controlled by an independent drive mechanism 28 (schematically shown in FIG. 2) controlled in a conventional manner by individual hand levers (not shown) provided in the driver's compartment 29. The skid-steer independent drive system 28 may be a conventional drive system, such as a hydrostatic drive system connected to the engine 32 (see FIG. 2) of the vehicle 10. For a more complete description of a representative drive system for the vehicle of the present invention, a drive system such as that shown in U.S. Pat. No. 3,635,635 and U.S. Pat. No. 3,866,700 may be employed. An internal combustion engine 32 that is cooled by a liquid coolant (such as water, ethylene glycol mixtures, or oil) is mounted in an engine compartment 34, generally defined by the uprights 14, a ventilating air input, in the illustrated instance louvered side openings 36, a front panel 38 and an upper sloped and at least partially louvered panel structure 40 provides for air exhaust from the engine compartment. As is conventional, the engine includes an engine block 30 which is mounted through vibration absorbing engine mounts 42 to cross frame members 44 in the engine compartment 34. The openings 36, front panel 38 and partially louvered or ventilating air output panel structure 40 along with the drive system 28, as well as other conventional parts of the vehicle are all connected to or form part of the vehicle frame 48.

Figure 2:
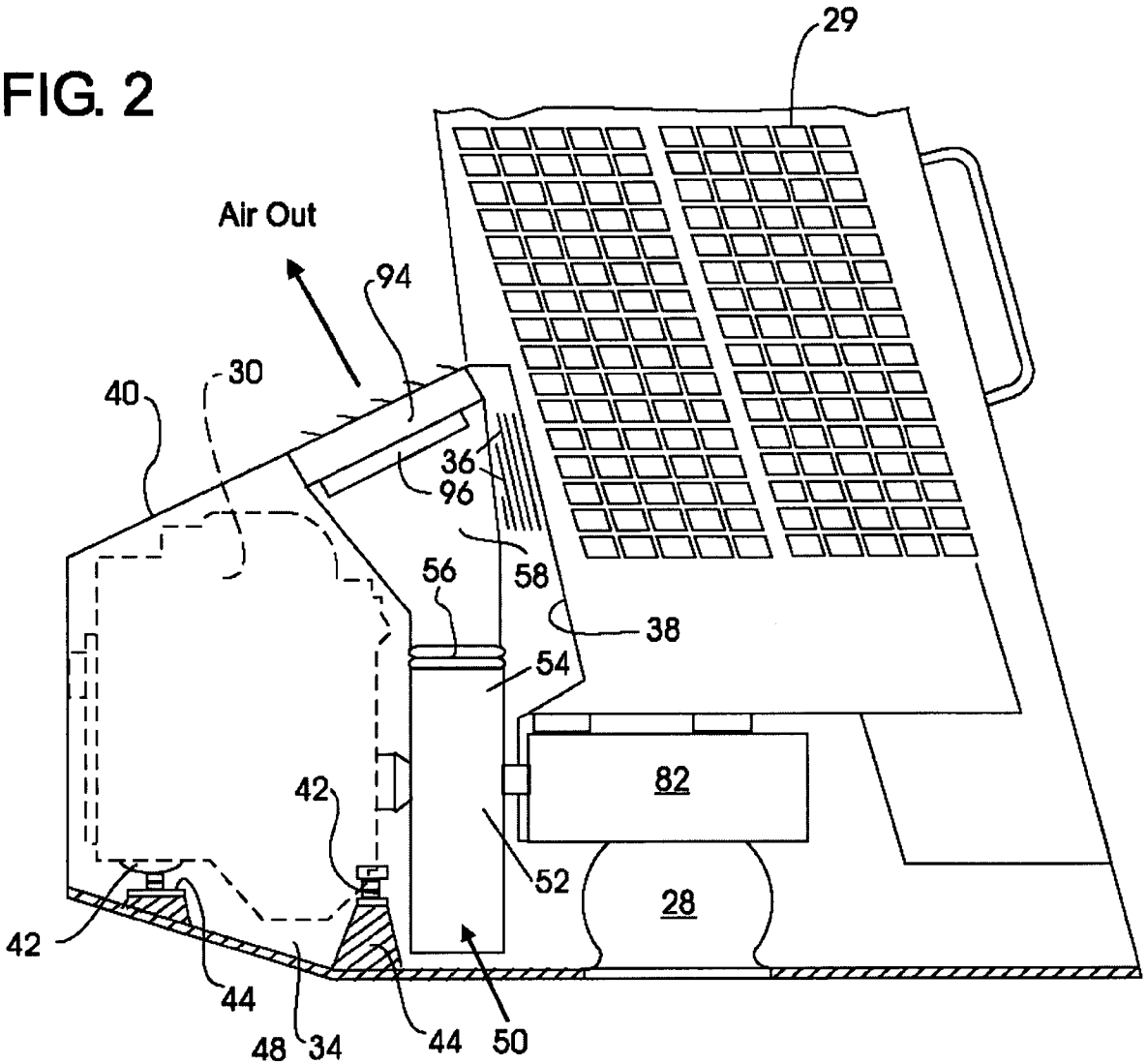
FIG. 2 is a partial, fragmented, schematic, side elevational sectional view of the engine compartment of the vehicle of FIG. 1 including the cooling system.
Figure 3:
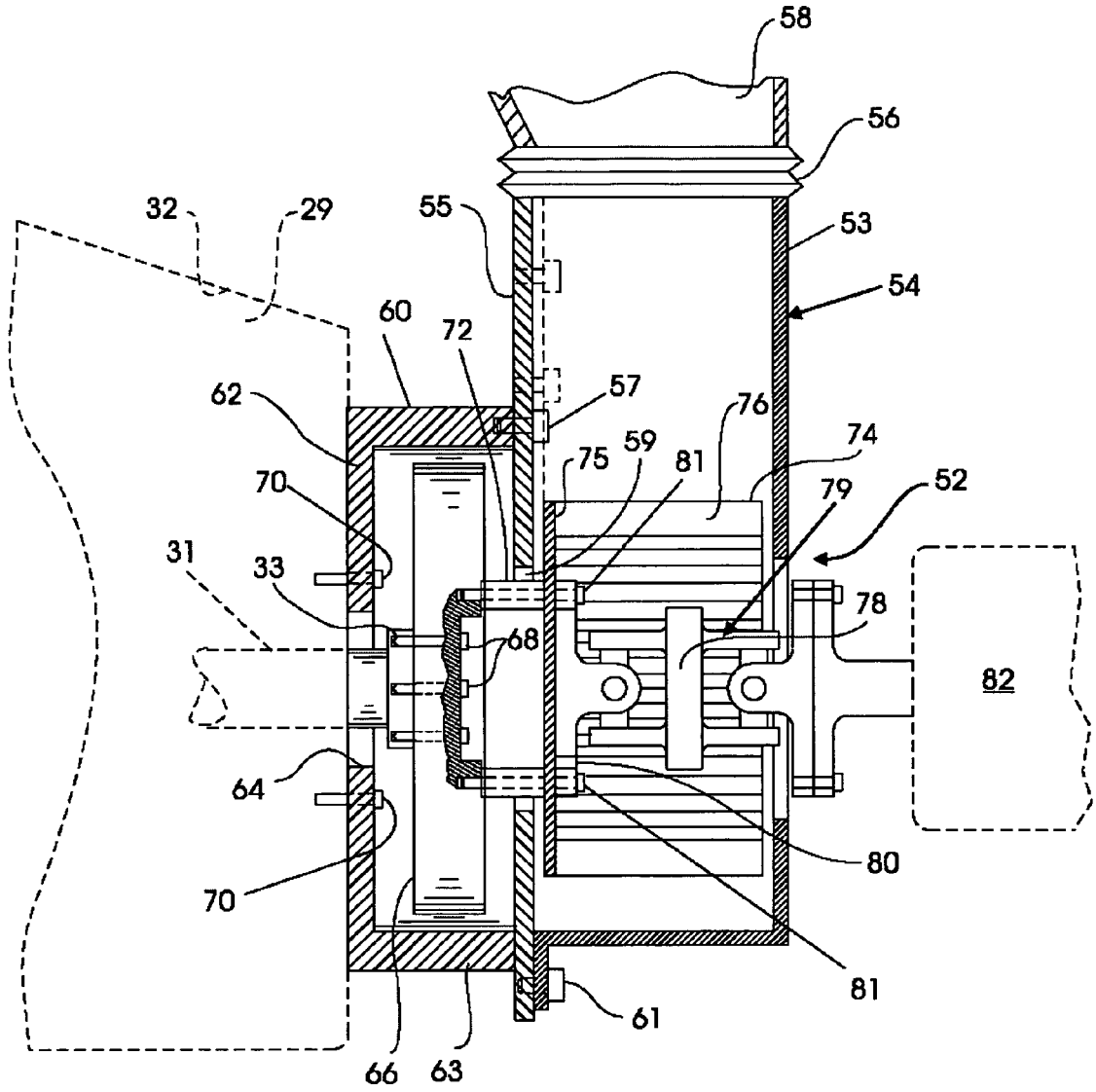
FIG. 3 is an enlarged, fragmentary sectional view in side elevation illustrating the construction of the attachment for the fan assembly including shroud and fan and its air output to the liquid and oil coolers of the vehicle shown in FIGS. 1 and 2.

In accordance with one feature of the invention, and for reasons which will become clear hereinafter, the cooling system 50 of the vehicle 10 is in part flexibly connected to the frame 48 of the vehicle while another part is rigidly connected to the engine 32. To this end, the cooling system comprises a centrifugal fan assembly 52 mounted at the rear of the engine 32 and connected thereto in a manner set forth below. A liquid cooler for cooling the liquid engine coolant (i.e. radiator) 94 is mounted adjacent the upper structure 40 at a forward end of the engine compartment 34 overlying, at least in part, the engine 32 and connected to the upper structure or frame in any convenient manner. An oil cooler 96 is mounted in the compartment 34 underlying the radiator 94. The openings 36 has air passages (ventilating openings) or louvers 35 provided therein to allow ambient air to circulate through the engine compartment 34. The fan assembly 52 is mounted to provide negative pressure in the engine compartment 34. That is, the fan 52 has a central air inlet which draws ambient air into the air openings 35 to carry the air over the engine 34 and recirculate it through an air outlet out the top of the engine compartment 34 through the oil cooler 96 and the radiator 94. As shown in FIGS. 2 and 3, the fan assembly includes a housing, casing, scroll or shroud 54 which is coupled by a flexible joint or coupling, in the illustrated instance a bellows 56, to an air diffuser 58 in fluid (air) communication with the oil and liquid coolers, 96 and 94 respectively. The flexible coupling or bellows 56 accommodates vibration caused displacement between the fan assembly and the radiator.

Turning now to FIG. 3, the apparatus for rigidly coupling the engine to the fan assembly 52 is shown therein. The engine 32 has a crankshaft 31 (shown in broken lines) which extends exteriorly of the engine 32 terminating in a flange 33 which is connected to a flywheel 66, in the illustrated instance as by bolts 68. A generally tubular flywheel housing 60, includes a base portion 62 connected to the engine as by bolts 70, and a cylindrical wall portion 63 which circumscribes the flywheel 66. The base portion 62 includes an aperture 64 therein dimensioned to accommodate the passage of the crankshaft 31 there through.

The shroud, casing, fan housing or scroll 54 is provided in two pieces, an exterior wall 53 and an interior wall 55, for ease of fan assembly and mounting in the engine compartment 34. The exterior wall 53 of the scroll 54 may be composed of any desirable, relatively lightweight but rigid material such as an ABS plastic. The interior wall 55 of the scroll 54, is preferably composed of a more rigid material, such as steel or aluminum which is secured to the tubular body portion 63 of the flywheel housing as by bolts 57 (one of which is shown in FIG. 3) while the exterior wall 53 is secured to the interior wall 55 as by bolts 61. The two halves therefore form the scroll 54, which is connected through the flywheel housing to the engine.

A fan 74 is preferably of the centrifugal type and is mounted for rotation interiorly of the scroll or shroud 54. As shown in FIG. 3, the fan comprises a base plate 75 from which a plurality of fan blades 76 extend. The fan 74, including base plate 75 and fan blades 76 may be constructed in any conventional manner such a single piece of cast aluminum.

Connection of the fan 74 to the engine 32 is by a rigid coupling to the flywheel 66. To this end, a tubular spacer 72 abuts the base plate 75 of the fan 74, projects through an aperture 59 in the interior wall 55 of the scroll or shroud 54, and is secured to the flywheel as by bolts and the like 81. In this manner as the crankshaft 31 rotates, so does the fan 74, interiorly of the shroud or scroll.

Since both the shroud 54 and fan 74 are connected to the engine, engine vibrations causing relative motion between the engine and frame cannot create differential movement or vibration between the fan and the scroll or shroud interior. This means that the fan 74 may be operated much closer to the interior of the scroll or shroud allowing for increases in fan operation and efficiency. Additionally, this results in an increase in volumetric efficiency that may be obtained with a smaller, more compact fan, which in turn allows for a further reduction in engine compartment size.

In the embodiment shown, the flywheel 66 is also coupled via bolts 81 to a pair of universal joints 78, 79 as by base plate 80 of the universal joint 78. The output of the second universal joint 79 is to hydraulic pumps 82 that operate the bucket and lifts of the vehicle.

The resultant cooling system concentrates the components of the system providing for a more compact engine structure, reduces the size of the cooling compartment, and therefore substantially improves the efficiency of the cooling system.

The present invention therefore provides a more compact, more efficient cooling system, which indirectly contributes to the improved maneuverability of the vehicle.

While the embodiments illustrated in the various drawings described above are presently preferred, it should be understood that those embodiments are offered by way of example only. The invention is not intended to be limited to any particular embodiment but is intended to extend to various modifications that nevertheless fall within the scope of the appended claims.

What is claimed is:

1. A cooling system for a work vehicle, the work vehicle including a generally enclosed engine compartment for housing an engine therein, the engine compartment including rear ventilating openings and an upper panel connected to a radiator mounted at a forward upper end of the engine compartment for air passage therethrough, an engine, including an engine block, mounted in the engine compartment at the rear of the vehicle, the cooling system comprising:

a fan assembly mounted to the engine, the fan assembly including:

a fan shroud rigidly connected to the engine block, and defining an air inlet and an air outlet;

a centrifugal fan rigidly connected to the engine for driven relation thereby interiorly of the shroud for forcing air from the inlet of the shroud to the outlet of the shroud to the radiator, the rigid coupling of the fan shroud and fan to the engine inhibiting differential vibration between the fan and fan shroud when the engine is in operation an air diffuser coupled to the radiator; and a flexible coupling intermediate the diffuser and the air outlet of the shroud, the fan configured and located to provide negative pressure within the engine compartment to draw circulating air into the engine compartment through the ventilating openings to thereby draw air through the ventilating openings, through the engine compartment and fan, and push it outwardly through the radiator.

2. The cooling system for a work vehicle as claimed in claim 1, further comprising an oil cooler, the oil cooler being disposed adjacent to the radiator, and wherein the engine includes a crankshaft with a portion thereof extending exteriorly of the engine block, and the fan rigidly secured to the extended portion of the crankshaft for rotation therewith when the engine is in operation and the shroud includes an exterior wall portion connected to an interior wall portion defining a housing for the fan, at least the interior wall portion of the shroud rigidly connected to the engine block thereby minimizing relative axial and radial displacement of the fan relative to the housing due to engine and vehicle vibration.

3. The cooling system for a work vehicle in accordance with claim 2, including a flywheel housing including a base portion and a tubular wall portion for circumscribing the flywheel; the housing being rigidly connected to the engine block and dimensioned to allow the flywheel to rotate interiorly of the housing.

4. The cooling system for a work vehicle in accordance with claim 3, wherein the shroud includes an exterior wall portion connected to an interior wall portion defining a housing for the fan, at least the interior wall portion of the shroud rigidly connected to the flywheel housing and thus the engine block thereby inhibiting relative axial and radial displacement of the fan relative to the housing due to engine and vehicle vibration.

5. A skid steer vehicle comprising:

a body portion;

a frame mounting the body portion;

an engine mounted interiorly of a generally enclosed engine compartment located at the rear of the vehicle and including ventilating openings, and the engine connected by engine mounts to the frame, the engine further comprising an engine block and a crankshaft mounted within the engine with a portion thereof extending externally from the engine block;

a radiator for cooling liquid mounted in the vehicle in close proximity to the engine;

an air diffuser connected to the radiator; and a flexible coupling comprising a bellows for accommodating vibration caused displacement between the fan assembly and the radiator connecting the air diffuser to the air outlet of the shroud;

a centrifugal fan assembly for cooling the engine compartment, the fan assembly comprising;

a shroud defining an air inlet and an air outlet, and a centrifugal fan within the shroud intermediate the air inlet and air outlet;

wherein the fan is rigidly secured to the extended portion of the crankshaft for rotation therewith when the engine is in operation, wherein the shroud includes an exterior wall portion connected to an interior wall portion defining a housing for the fan, and wherein at least the interior wall portion of the shroud is rigidly connected to the engine block thereby inhibiting relative axial and radial displacement of the fan relative to the housing due to engine and vehicle vibration.

6. The skid steer vehicle in accordance with claim 5, further comprising an oil cooler, wherein the radiator is mounted in the engine compartment, wherein the oil cooler is disposed adjacent to the radiator, whereby air flowing through the radiator also flows through the oil cooler.

7. The skid steer vehicle in accordance with claim 6, wherein the vehicle further comprising a flywheel directly connected to the extended portion of the crankshaft; the fan being connected to the flywheel for rotation therewith.

8. The skid steer vehicle in accordance with claim 7, and further comprising a flywheel housing defining a base portion and a tubular wall portion for circumscribing the flywheel; wherein the flywheel housing is rigidly connected to the engine block and dimensioned to allow the flywheel to rotate interiorly of the housing.

9. The skid steer vehicle in accordance with claim 8, wherein at least the interior wall portion of the shroud is rigidly connected to the flywheel housing and thus the engine block, thereby inhibiting relative axial and radial displacement of the fan relative to the housing due to engine and vehicle vibration.

* * * * *